US006034474A

United States Patent [19]

Ueoka et al.

[11] Patent Number: 6,034,474

[45] Date of Patent: Mar. 7, 2000

[54] COLOR PLASMA DISPLAY PANEL WITH ELECTROMAGNETIC FIELD SHIELDING LAYER

[75] Inventors: Mitsuo Ueoka; Toshiyuki Akiyama, both of Tokyo, Japan

[73] Assignee: NEC Corporation, Tokyo, Japan

[21] Appl. No.: 09/060,461

[22] Filed: Apr. 15, 1998

[30] Foreign Application Priority Data

Apr. 15, 1997 [JP] Japan ..... 9-097253

[51] Int. Cl.[7] ..... H01J 17/49; H01J 1/52; H01J 17/04

[52] U.S. Cl. ..... 313/584; 313/586; 313/587; 313/489

[58] Field of Search ..... 313/422, 485, 313/582, 584, 587, 586, 489, 492; 315/169.4; 348/819, 820; 174/35 R

[56] References Cited

U.S. PATENT DOCUMENTS

| | | | |
|---|---|---|---|
| 3,666,981 | 5/1972 | Lay | 313/584 |
| 3,885,195 | 5/1975 | Amano | 313/485 |
| 4,446,402 | 5/1984 | Dick | 313/586 |
| 5,288,558 | 2/1994 | Nöthe | 313/489 |

FOREIGN PATENT DOCUMENTS

| | | | |
|---|---|---|---|
| 4-134900 | 5/1992 | Japan | H05K 9/00 |
| 4-245140 | 9/1992 | Japan | H01J 11/00 |
| 6-5202 | 1/1994 | Japan | H01J 9/227 |
| 7-21924 | 1/1995 | Japan | H01J 11/02 |

*Primary Examiner*—Michael H. Day
*Attorney, Agent, or Firm*—Young & Thompson

[57] ABSTRACT

An electromagnetic field shielding layer made of an electroconductive material and having windows corresponding to display cells is formed on a substrate on the side of display. Color filters are provided on the windows of the electromagnetic field shielding layer to allow the electromagnetic field shielding layer to exist on boundaries between adjacent color filters. The electromagnetic field shielding layer and color filters may be covered with an insulating body layer.

5 Claims, 4 Drawing Sheets

COLOR PLASMA DISPLAY PANEL WITH ELECTROMAGNETIC FIELD SHIELDING LAYER

BACKGROUND OF THE INVENTION

1. Field of the Invention

This invention relates to a color plasma display panel which is used for an information displaying terminal or a flat type television set, and particularly to a panel structure to achieve a display with high contrast and brightness.

2. Prior Art

A color plasma display panel is a display device which excites phosphors to cause them to emit visible light by ultra-violet rays generated as a result of gas discharge, thereby achieving a color display. The color plasma display panel can be divided into AC and DC types according to the formation of gas discharge. Of the two, AC type is better than DC type in brightness, luminous efficiency, and life. Of AC type variations, a reflection AC type is excellent in brightness and luminous efficiency.

FIG. 1 shows the cross-section of one example of a conventional reflection AC type color plasma display. On a transparent glass substrate 1 is formed a discharge electrode 2 made of a transparent material. A plurality of discharge electrodes are disposed like belts in a direction parallel to the surface of the drawing. Between given adjacent discharge electrodes 2 is applied an AC voltage in the form of a series of pulses with a frequency of several tens kHz to several hundreds kHz to obtain a discharge for display.

With the reflection type AC surface discharge color plasma display, a transparent electrode made of tin oxide ($SnO_2$) or indium tin oxide (ITO) has been used as the discharge electrode 2 so that visible light from phosphors may not be intercepted. However, the foregoing transparent material has a comparatively high sheet resistance. Therefore, when incorporated into a large-sized panel or a high precision panel, it gives an electric resistance as high as several kΩ, and even when a voltage is applied thereto, the voltage does not rise sufficiently rapidly to achieve a smooth driving. As a measure to solve this problem, a thin metal layer of either a laminated thin film composed of chromium/copper/chromium or an aluminum thin film, or a thick metal layer such as silver is provided on certain parts of the transparent electrode to form a bus electrode (not shown), thereby enabling a discharge electrode to have a lowered electric resistance.

On this discharge electrode 2 are formed color filter layers 3*r*, 3*g* and 3*b* each made of a pigment particle layer extending in the form of a stripe as if to intersect at right angles with the discharge electrode 2. Generally, for the color filter layer 3 is used a material which has an optical property to transmit only the optimum element of emitted light from a phosphor layer 8 placed opposite thereto. Further, the color filter layers 3 are covered with a transparent dielectric layer 4. This dielectric layer 4 has a function to limit an electric current characteristically associated with an AC type plasma display. The dielectric layer 4 is usually produced after a paste mainly composed of lead glass with a low melting point has been coated, and fired at a temperature higher than the softening point thereof, and the glass been allowed to flow on the surface to form a smooth layer having a thickness of 20–40 μm with no air bubbles captured therein, because this method allows an easy production of the layer in question and will impart it a property to keep insulation in the presence of a higher voltage.

Next, a protecting layer (not shown) is formed to cover the whole expanse of dielectric layer 4. This is a thin MgO layer formed by chemical vapor deposition process or by sputtering process, or a thick layer of MgO formed by printing process or by spraying process. It has a thickness of about 0.5–1 μm. The role of this protecting layer is a reduction of a discharge voltage and a prevention of a surface sputtering.

On the other hand, on a back substrate 5 are formed address electrodes 6 upon which display data pulses are applied. In FIG. 1, address electrodes 6 extend in a direction normal to the surface of the drawing, and are formed on places corresponding with red, green and blue phosphor layers 8 arranged in the form of a stripe as will be described later. Namely, the address electrode 6 intersects the discharge electrode 2 on the front substrate 1 with right angles. These address electrodes 6 are covered with a white dielectric layer 7 which is produced after lead glass with a low melting point and a white pigment has been mixed to produce a paste for a thick layer which has then been printed and baked. The white pigment usually includes a titanium oxide powder or aluminum oxide powder. On this white dielectric layer 7 are formed barriers 9 to define spaces for electric discharge, usually by printing process. Further, on the top of barrier is thickly printed a paste usually consisting of a metal oxide powder of iron, chromium or nickel, and glass with a low melting point, and thus the top, having a color of black, is prevented from reflecting light coming from a bright environment. Furthermore, the barriers 9 are also effective in preventing wrongly induced electric discharges or optical cross-talks which would otherwise take place between adjacent discharge cells.

On the surface of discharge cell 10, phosphors 8*r*, 8*g* and 8*b* which give red, green and blue visible lights, respectively are coated one time for each phosphor, or three times for all the phosphors. Each phosphor is coated on the side walls of barrier, to increase the phosphor coat area, thereby achieving a higher brightness. Coating of the phosphor usually takes place by screen printing.

Later, the front substrate 1 and back substrate 5 are placed opposite so that the discharge electrodes 2 of the former and the address electrodes of the latter intersect with each other with right angles with the barriers in between, and their joints are hermetically sealed air-tight. A dischargeable gas, for example, a mixture of He, Ne and Xe is injected into the interior of discharge cells under a pressure of about 500 Torr.

In FIG. 1, two discharge electrodes are assigned to each discharge cell, and a surface discharge is generated in the gap between these discharge electrodes to produce a plasma in the discharge cell. Vacuum ultra-violet rays generated during this process excite red, green and blue phosphors 8*r*, 8*g* and 8*b*, and cause them to emit visible light which are filtered through filters 3 on the front substrate 1 to give light for display.

One of a pair of adjacent discharge electrodes acts as a scan electrode and the other acts as a sustain electrode. To continue the discharge, sustain pulses are applied between the scan electrode and sustain electrode. To generate a write discharge, a voltage is applied between the scan electrode and address electrode 6 to allow an across-discharge to be generated therebetween, which is then taken over by sustain pulses subsequently imparted to develop into a sustaining discharge between the surface discharge electrodes.

A phosphor used in a color plasma display panel is composed of a white powder having a high reflective index. With the conventional color plasma display panel described above, when external light from indoors as well as outdoors impinges on the panel, the majority of light is absorbed by the top of barriers and bus electrodes, but about 30–50% thereof is reflected back, thereby greatly impairing the contrast and color purity of display. To avoid such reflection of external light and ensure a high contrast display, a method may be employed which consists of the use of a neutral density (ND) filter with a light transmission of 40–80%, but as that filter will cut some of visible elements of the luminescence from phosphor, the luminance of display on the panel will be reduced.

As a method whereby it is possible to minimize the reflection of external light without impairing the luminance of display as much as possible, introduction of color filters 4 has been proposed. This method consists of placing color filters 4 allowing red, green and blue light to pass on the viewing side in correspondence with red, green and blue luminescence emitted from respective discharge cells.

To introduce such color filters into an AC type plasma display, there have been known two methods: one is to place the filters directly on the surface of glass substrate, and the other is to prepare a dielectric layer necessary for the AC type plasma display as a colored glass layer.

A conventional example of a color plasma display panel incorporating such color filters can be seen, for example, in FIG. 6 of Japanese Unexamined Patent Publication No. 6-5202.

The conventional color filters are produced after materials usually containing a pigment powder as a main ingredient corresponding to respective colors have been prepared, applied to a substrate to form layers thereupon separately for each chromatic component, and fired. Incidentally, as the pigment powder must withstand a high temperature (500–600° C.) during firing process, inorganic materials must be chosen therefor. Representative pigment powders are shown below.

Red: $Fe_2O_3$ compounds

Green: $CoO—Al_2O_3—Cr_2O_3$ compounds

Blue: $CoO—Al_2O_3$ compounds

As the aforementioned filter layers are printed separately for the three color components, red, green and blue, namely, printing takes place three times in total to complete the formation of entire color filter layers, seams, grooves or steps may be generated between adjacent color filters. These flaws may damage insulations between other circuit elements or have adverse effects on the later processes necessary for the formation of black barriers.

To avoid such adverse effects as described above, a method is presented whereby the color filter made of colored glass with a low melting point is further coated by a transparent dielectric layer thereby to smoothen the surface of color filter. The structure of such color filter is disclosed in Japanese Unexamined Patent Publication No. 7-01924. Alternatively, different pigments corresponding to those primary colors have been pasted separately, and then glass paste with a low melting point is printed on the entire surface, and the assembly is fired, to allow thereby the pigments to disperse or diffuse into the glass layer (Japanese Unexamined Patent Publication No. 4-245140 is referred to).

As these conventional color plasma display panels have color filters corresponding to respective visible components of luminescence placed on a substrate on the side of display, and thus is capable of suppressing the reflection of external light in the manner as described above, it can achieve a high contrast display. As the color filter is so transmissible to visible rays as to pass about 60–80% of rays having a mid wavelength of the spectra corresponding to red, green or blue light, 40–20% loss in brightness results. To achieve the same degree of contrast with above, the ND filter must have a transmission of about 50% to visible rays. Accordingly, as long as contrast being kept the same, a color filter can allow more light to pass than does the ND filter, or a color filter can allow a higher luminance than does the ND filter. Furthermore, luminescence from the phosphor can be modified through adjustment of the properties of color filter so as to optimize the color purity and hue of the luminescence. In addition, the color filters can intercept visible rays (for example, orange rays from Ne gas) emitted from a discharge gas, and thus contributes to a widening of reproducible color range.

On the other hand, when a high AC voltage pulse is applied to generate a discharge for display, an impulse current is generated, and flows through a driving circuit and color plasma display panel. This impulse current causes an electromagnetic field to radiate. A method to suppress the radiation of electromagnetic field from the display surface consists of placing an electroconductive electromagnetic field shielding plate on the front surface of display, and connecting its margins to the housing to ground it. What is disclosed in Japanese Unexamined Patent Publication No. 4-134900 is generally known as a conventional example incorporating such structure. The electromagnetic field shielding plate generally consists of a transparent insulating plate of an acryl resin or glass with a flat thin film applied thereupon as an electrode, or the same plate with a mesh made of electroconductive fibers bonded thereupon. In the conventional example described above, an indium tin oxide (ITO) film is used. The surface resistance of this electromagnetic field shielding film is preferably 1 Ω/□ or less, but generally a thin transparent film electrode highly transmissible (about 80%) to visible light generally has a surface resistance of 10 Ω/□ or less, and thus its electromagnetic field shielding effect is insufficient. Thus, various trials have been made to reduce the surface resistance of transparent electroconductive film without sacrificing its transmission to visible light, for example, by adjusting the conditions of film formation or by applying various metal films thereupon.

By contrast, a mesh of electroconductive fibers gives a surface resistance of 0.1 Ω/□, and has a sufficient electromagnetic field shielding activity. However, when the mesh is applied on the surface of display, it generates a moire pattern through interference with a frame pattern of display cells. This moire pattern can be made negligible through adjustment of the diameter of wires constituting the mesh, size of mesh opening, and angle of mesh with respect to the display surface, but can not be annihilated. Further, the wires constituting the mesh narrows the view angle. Furthermore, as the mesh is produced after resin fibers have been woven into a cloth upon which a metal such as copper or nickel has been plated, its mesh opening has a limitation in size, and passes only about 50–60% of visible light incident on the mesh.

The color plasma display panel dependent on the use of color filters also requires the placement of an electromagnetic field shielding plate as an essential element for the reasons as described above. Thus, when a mesh of electroconductive fibers having a low transmission to visible light is introduced to shield electromagnetic fields in the manner as described above, it cancels out the high contrast effect brought about by the introduction of color filters, and damages advantages and effects imparted to the color plasma display panel incorporating color filters, and thus disables the practical application thereof.

The conventional color plasma display panel with color filters, although being capable of providing a display high in contrast and brightness, and wide in color reproducibility as described above, requires the use of an electromagnetic field shielding plate to shield electromagnetic fields as an essential element, but, as the plate in question having a low transmission to visible light, its existence lowers the brightness of display, and cancels out the advantages brought about by the color filters. For this reason, it has been difficult to put the color plasma display panel incorporating color filters into practice.

SUMMARY OF THE INVENTION

This invention provides a color plasma display panel with color filters which gains a practical applicability by imparting an electromagnetic field shielding properties to a substrate on the side of display without sacrificing the transmissibility of the substrate to visible light, and by emphasizing therewith the advantages brought about through introduction of those color filters.

The color plasma display panel of this invention includes discharge electrodes made of transparent electrodes. A front substrate on the display side is provided with a plurality of color filters corresponding with, for example, red, green and blue. A background substrate is placed opposite to the front substrate to form spaces for discharge therebetween. Thus display cells are formed between the two substrates and a rare gas is filled in the cells to generate ultra-violet rays during the discharge. Phosphors are then excited by the ultra-violet rays to generate visible light which are allowed to pass through the filters for display. According to the present invention, an electromagnetic field shielding layer made of an electroconductive material and having at least windows through the substance is provided on the front substrate. And the color filters are placed opposite to those windows. The electromagnetic field shielding layer is placed on boundaries between adjacent color filters, and the entire surface of electromagnetic field shielding layer and color filters are coated by an insulating body layer.

This invention is further characterized by providing the color plasma display panel wherein, after a planar transparent electrode has been formed on the front substrate, the electromagnetic field shielding layer and color filters are formed.

The color plasma display panel of this invention is furthermore characterized by preparing the frames of display cells and of the windows of electromagnetic field shielding layer in the pattern of a grid such that the two patterns correspond perfectly.

The color plasma display panel of this invention is still further characterized in that the electromagnetic field shielding layer is of practically black, or, as a summation effect with the color of color filters, is of practically black.

This invention, instead of placing an electromagnetic field shielding plate on the display surface as is often seen with conventional panels, adopts a structure wherein an electromagnetic field shielding layer made of an electroconductive material and having windows is placed on a substrate on the side of display.

This arrangement makes it possible for the windows of electromagnetic field shielding layer of the present invention to be placed in correspondence with display cells, a feat inaccessible to the electromagnetic field shielding plate of a conventional panel. Therefore, with this invention it is possible to maintain an electromagnetic field shielding activity while still not interfering with the brightness of display. Accordingly, it is possible for this invention to provide a practicable color plasma display panel without sacrificing the features brought about through introduction of color filters.

DESCRIPTION OF THE PREFERRED EMBODIMENTS

Figure 1:
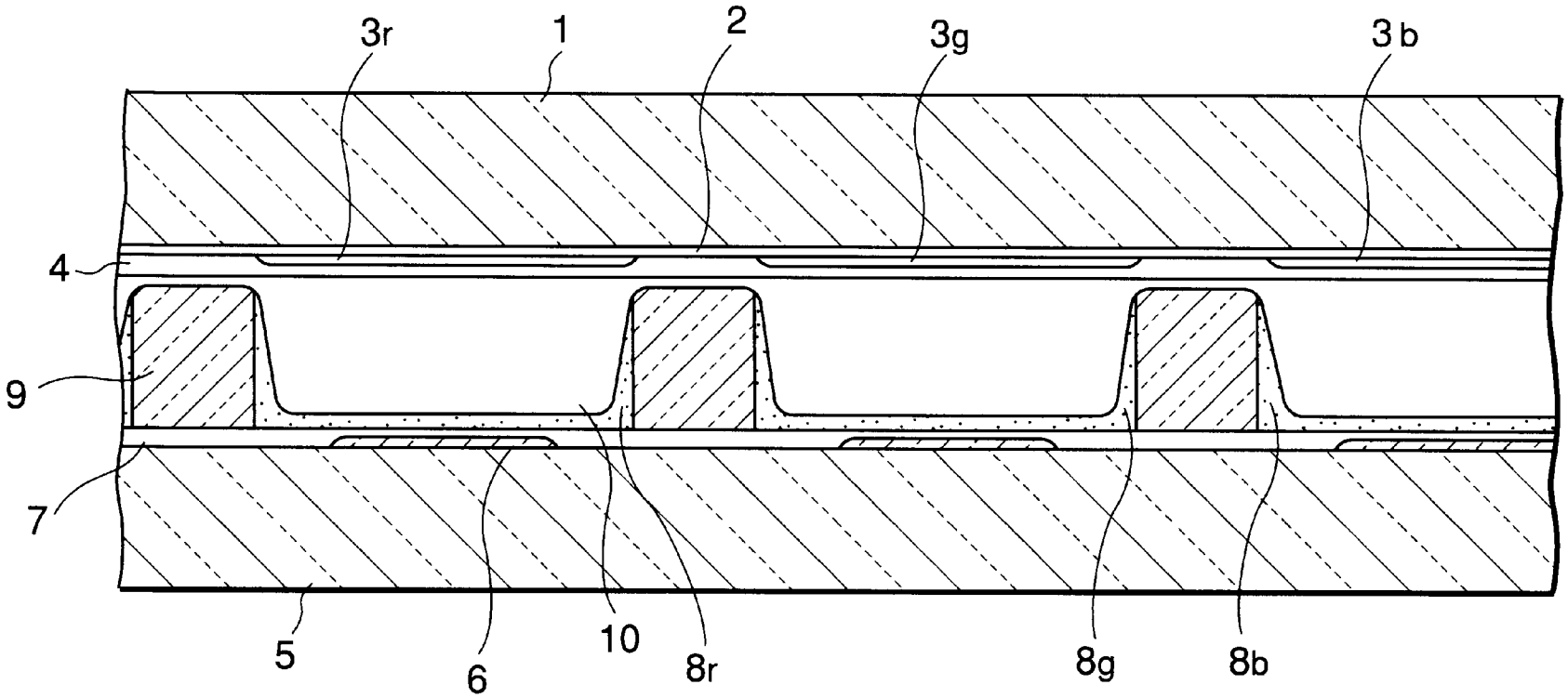
FIG.1 (PRIOR ART)
FIG. 1 is a schematic diagram showing the cross-section of a conventional color plasma display panel.
Figure 2:
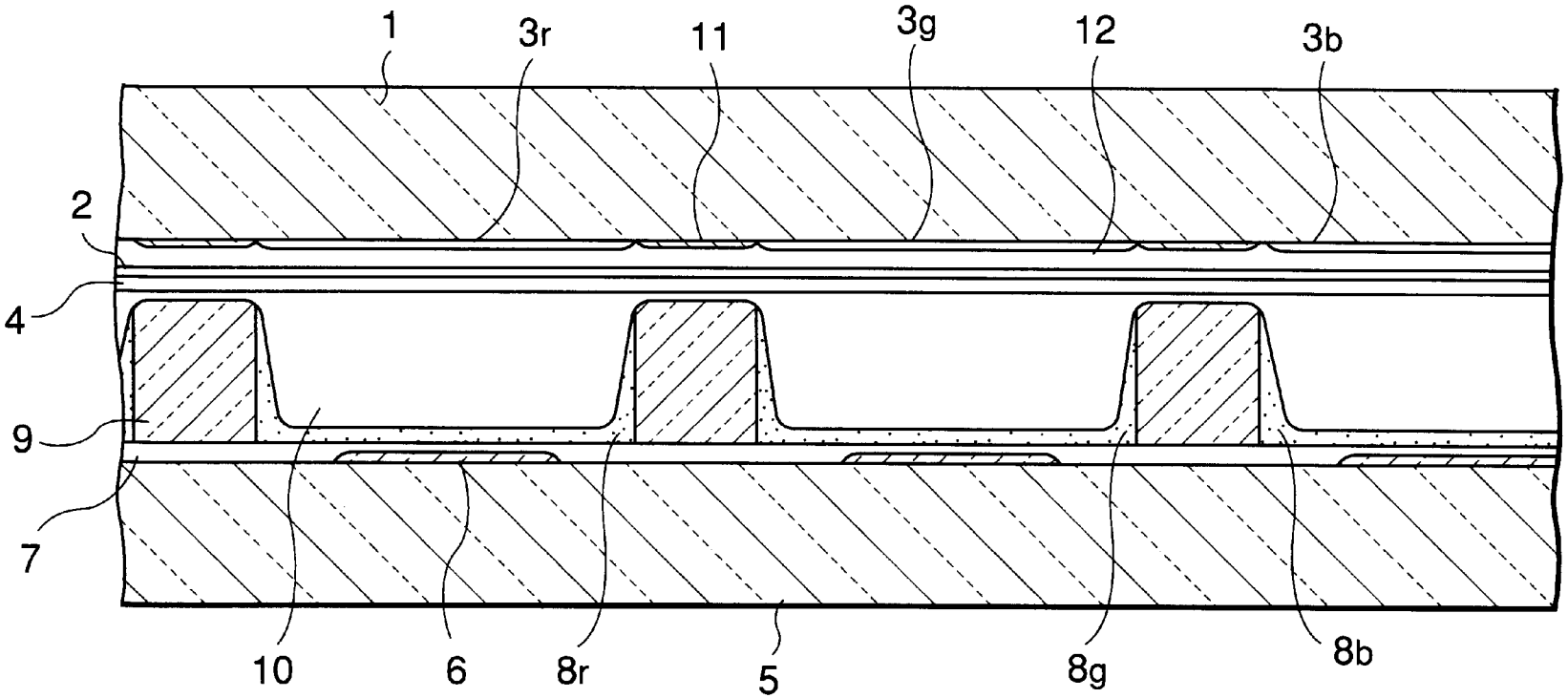
FIG. 2 is a schematic diagram showing the cross-section of a color plasma display panel according to a first example of this invention.

Referring to FIG. 2, a back substrate 5, like the one of the conventional panel shown in FIG. 1, is produced after on a glass substrate have been formed address electrodes 6, a white dielectric layer 7, barriers 9, and phosphor layers 8*r*, 8*g* and 8*b* in this order. Discharge cells 10 to produce visible light with different colors are bounded by a transparent electrode 2 on a front substrate 1 placed opposite as well as by the address electrodes 6 and barriers 9. Adjacent barriers have a pitch of 350 $\mu$m and each barrier has a width of about 80 $\mu$m. Those barriers are arranged like ribs stretching in parallel with the surface of the drawing.

On the other hand, a front substrate has an electromagnetic field shielding layer 11 formed thereupon. To produce this layer, it is possible to use an evaporation technique whereby a three-layered structure composed of chromium, copper and chromium is formed, and then to apply a photoetching technique whereby the above structure is modified to have a grid structure. In this invention, however, a film coating technique is employed. A photosensitive resin is applied onto the display side surface of substrate 1, and exposed to light and developed to reproduce a grid pattern similar to that of display cells. Onto the grid pattern a black pigment paste is applied, and dried. Then, a silver paste is added thereupon, and the assembly is fired. Incidentally, the black pigment paste contained as a main ingredient lead glass with a low melting point and a black pigment. The black pigment consisted of oxides of iron, cobalt and chromium. This electromagnetic field shielding layer 11 has a thickness of about 5–20 $\mu$m. Then, color filter layers 3*r*, 3*g* and 3*b* are formed in this order by the procedure as described below, in such a way that their color corresponds with the color of luminescence the phosphor contained in respective phosphor layers 8 generates. The procedure in question depended on the film coating technique. As the electromagnetic field shielding layer 11 has a thickness of 5–20 $\mu$m as mentioned earlier, the lateral edges of layer in question printed in the pattern of a grid act like fences when a color filter paste is applied for color filter printing. Thus, mixing of adjacent color pastes can be safely avoided, and printing process is easy to apply.

Firstly, to a finely powdered pigment red in color and mainly composed of iron oxide are added a binder and a solvent, which are then blended to produce a paste. The paste is applied by screen printing to give a stripe of bands which have a pitch of 1.05 mm between each other and a width of about 390 μm each. The assembly, being heated to about 150° C., is dried by allowing the solvent to vaporize. Immediately thereafter, to a finely powdered pigment green in color and mainly composed of oxides of cobalt, chromium and aluminum are added a binder and a solvent, which are then blended to produce a paste. The resulting paste is applied by screen printing to give a stripe of bands which is displaced by 350 μm from, and in parallel with, the red stripe already printed, and dried. Finally, to a finely powdered pigment blue in color and mainly composed of oxides of cobalt and aluminum are added a binder and a solvent, and the resulting paste is printed and dried by the same method. Three printings of different pigments in this way allow the entire surface corresponding to a display section to be totally covered with the three kinds of pigments. Then, the three kinds of pigments thus printed are fired simultaneously at about 520° C. After firing process, all the color filter layers have a thickness of about 2 μm in common. Particles constituting those pigments of inorganic compounds are very fine, having a diameter of about 0.01–0.05 μm, and thus forms a very dense layer. A paste of glass with a low melting point is added thereupon by screen printing and fired at about 570° C. to melt, thereby producing a transparent insulating body layer 12 with a thickness of about 50 μm. This insulating body layer 12 is formed at a firing temperature, that is, the temperature as described above, which allows the glass with a low melting point to melt, and a smooth, transparent dielectric layer with no air bubbles captured within to form.

In later processes, the assembly is treated by the same method as applied to a substrate on the display side of a conventional color plasma display panel. The discharge electrode 2 consisted of a transparent electroconductive film of tin oxide ($SnO_2$) or indium tin oxide (ITO). On one portion of this transparent electroconductive film is formed another film comparatively thick and made of silver to complete the discharge electrode 2.

A transparent dielectric layer 4 is coated on this discharge electrode 2, and then a protecting layer of MgO is applied to cover the entire surface of dielectric layer 4, thereby completing the structure of front substrate 1.

Finally, the front substrate is placed opposite to the rear substrate 6, and bonded thereto with the joints hermetically sealed. The spaces formed between the two substrates are evacuated, and filled with a discharge gas. Thus, the color plasma display panel of this invention is completed.

Incidentally, as the color plasma display panel of this invention incorporates color filters, the display surface assumes a tinge of light bluish green because of reflection of external light by color filters corresponding in color to three primary colors. As a display surface being devoid of any color is generally favored, a powdered pigment of inorganic compounds and yellow or brown in color may be added to the electromagnetic field shielding layer 11 of this invention, so that the tinge imparted therewith to the shielding layer 11 may mix with the tinge of the reflected external light, thereby to cancel the effect of the latter, that is, to practically eliminate the display surface of any coloration. Further, when a pigment of an inorganic compound and black in color is added so as to impart a black color to the electromagnetic field shielding layer 11, reflection of external light by the display surface is lessened, and a display with an excellent contrast is obtained.

Figure 3:
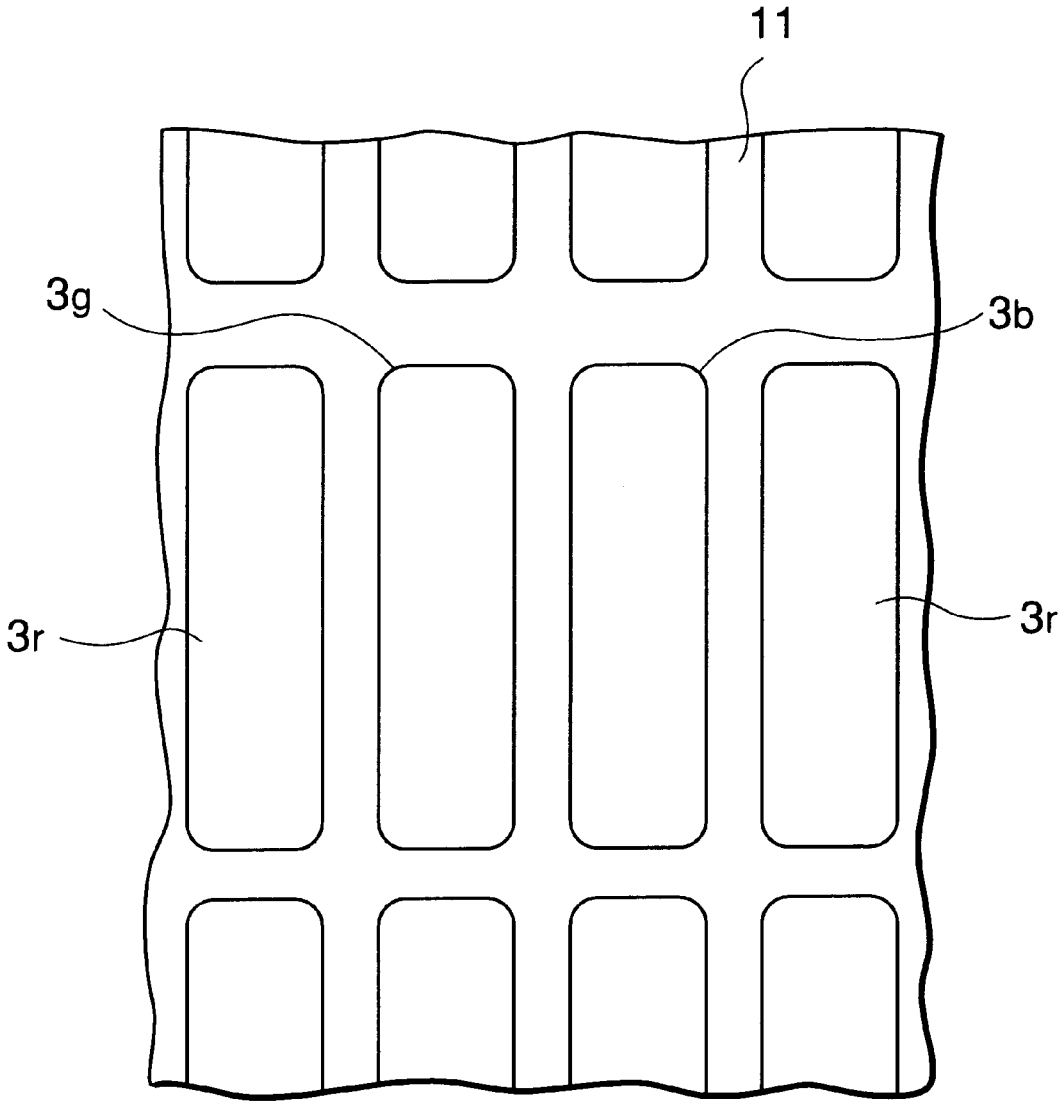
FIG. 3 is a schematic diagram showing the flat view of a color plasma display panel according to an example of this invention.

Next, the pattern of the electromagnetic field shielding layer 11 of this invention will be explained by referring to FIG. 3. In this example, the electromagnetic field shielding layer 11 has windows (their frames are patterned like a grid) which have a rectangular form and whose contour is so arranged as to surround the opening of discharge cells 10 to give red, green and blue light, and have red, green and blue color filter pastes applied onto those windows by printing process. The printing process was performed three times one time for each color filter paste: a color filter is printed to stretch along a line facing and in parallel with a corresponding address electrode 6, and three color filters are printed in the same manner to produce a stripe pattern. During this process, as the lateral edges of electromagnetic field shielding layer act as fences to pastes, mixing of adjacent color pastes can be effectively avoided as described above. But, as the electromagnetic field shielding layer has color pastes directly printed on the upper and lower ends of windows, mixing of adjacent color pastes sometimes resulted there. To avoid such mixing, the every corners of window are rounded (R is added to each angle of window) as shown in FIG. 3. One method by which to avoid mixing of adjacent color pastes is to print the color pastes in a series of dots, instead of a continuous line, each of which corresponds with the window of electromagnetic field shielding layer 11. But this method requires a high precision in positioning of the printed dots, and can not be applied for the production of a large-sized, high-precision color plasma display panel. During printing process color filter pastes printed in the pattern of a stripe partially overlap with the electromagnetic field shielding layer 11, and they may be often printed thickly along the edges of the overlapped areas (which intersect with the color filter pattern). Further, this overlapped areas may often be a place where mixing of adjacent color filter pastes take place because there are no fences there to intercept the flow of color filter pastes. As a means for preventing this, rounded corners are added to the angles of window, to not only enlarge the width of the upper end of electromagnetic field shielding layer 11 partially, but also to lessen the edge portion which intersects with the color filter pattern.

Through this arrangement, the electromagnetic field shielding layer in the pattern of a grid of this example achieves an electromagnetic field shielding of about 20–30 dB without sacrificing therewith the brightness of luminance.

There is an alternative method whereby the windows of electromagnetic field shielding layer 11 are arranged like a stripe whose individual bands run opposite to and in parallel with address electrodes 6. When the display panel produced by this method is compared with that by the previous method, its electromagnetic field shielding effect is lower by 5–20 dB, but the intensity of luminescence it allows to impinge on the panel is higher by about 20%. When this method is applied for the production of a color plasma display panel with a comparatively small panel size and thus a comparatively low electromagnetic radiation, it allows the display to have a higher brightness and higher contrast.

Figure 4:
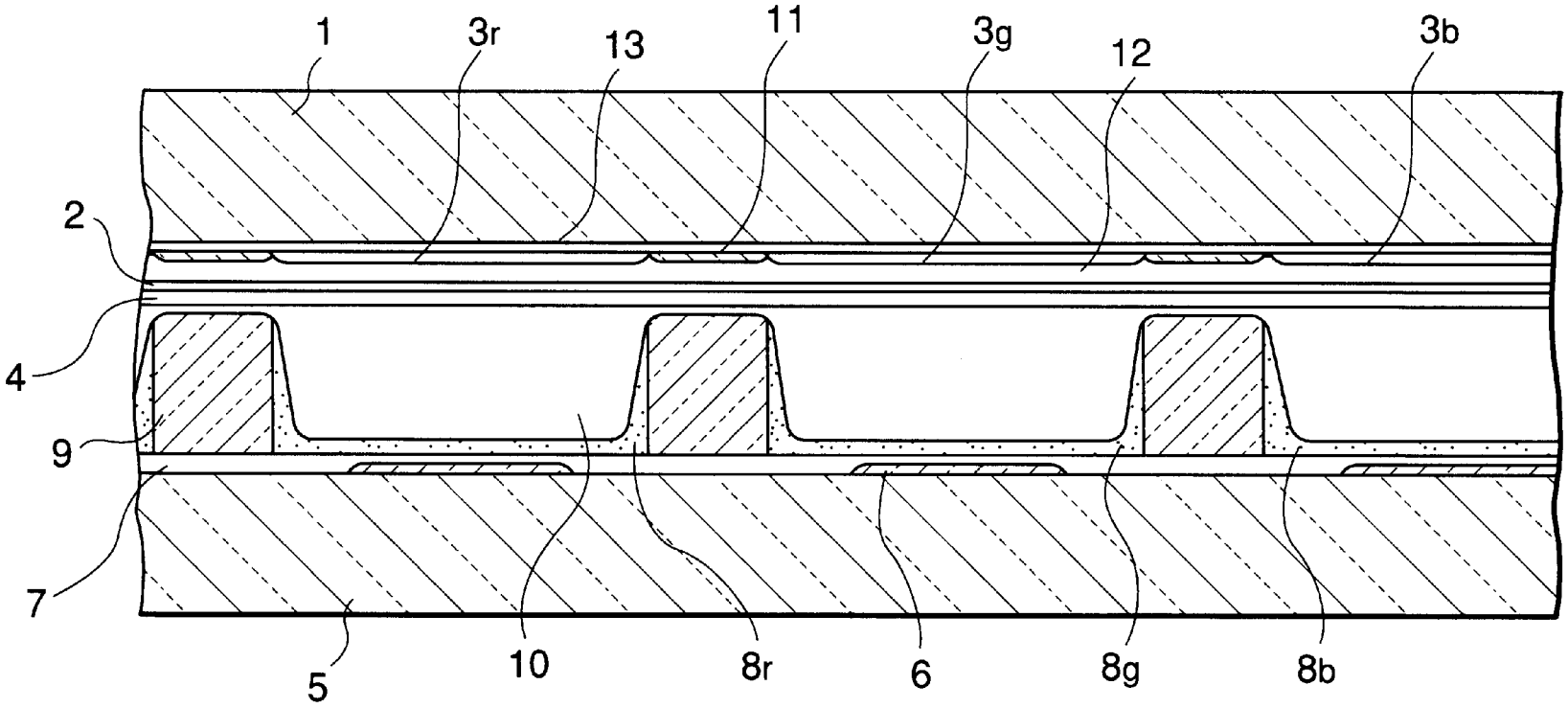
FIG. 4 is a schematic diagram showing the cross-section of a color plasma display panel according to a second example of this invention.

Then, description will be given of a second example by means of FIG. 4. This puts an emphasis on a device to enhance the electromagnetic field shielding effect of electromagnetic field shielding layer 11, and the device is particularly effective when applied to a large-sized panel. In this example, a transparent electrode 13 is added to the color plasma display panel of first example. This transparent electrode 13 is constituted of a transparent, electroconductive layer with an even thickness covering the entire surface of a substrate on the display surface. This transparent, electroconductive layer has a surface resistance of about 100 Ω/□, and a transmission of 95% or more to visible rays, in contrast with the same layer used in a conventional panel. On this transparent electrode, is formed the electromagnetic field shielding layer 11. Through this arrangement the windows themselves of electromagnetic field shielding layer 11 become electrically conductive, and thus the electromagnetic field shielding effect is enhanced by 10–20 dB even when the transparent electrode has a comparatively high surface resistance. In addition, as the transparent electrode has a transmission of 95% or more to visible light, a highly bright display can be obtained.

Furthermore, even when each of the display cell is enlarged, and, in association, the window of electromagnetic field shielding layer 11 is widened, a lowering of electromagnetic field shielding effect is more effectively avoided as compared with the display panel of Example 1.

As the electromagnetic field shielding layer 11 is made of a highly conductive material such as silver, and placed relative to the luminous cells in such a way as to surround the latter by the contour of its windows, it brings about an electromagnetic field shielding effect as much as or more than does a conventional electromagnetic field shielding layer made of a metal mesh. In addition, as it does not interfere with visible light emitted from phosphors, it enhances, in a practical sense of word, the brightness of color plasma display panel.

As described above, as the electromagnetic field shielding layer of this invention is placed relative to the display cells in such a way as to surround the latter with the contour of its windows, it brings about a sufficient electromagnetic field shielding effect, and nevertheless it causes no lowering of luminance. Thus, the advent of this invention will dissolve the problem of lowered luminance which may otherwise result when color filters are introduced in a color plasma display panel.

Further, the electromagnetic field shielding layer of this invention also acts as a guide when color filter layers are formed in a subsequent process by printing, and thus printing of color filters can be achieved smoothly with a high yield. Furthermore, imparting an infra-red ray cutting-off ability to an insulating layer, or an indispensable element of a color plasma display panel with the structure here concerned makes it possible for the panel to cut off infra-red rays. The panel obtained by above method achieved, at a lower cost, electromagnetic field shielding and infra-red ray cutting-off as well as or better than a corresponding conventional display panel with a filter plate capable of shielding electromagnetic fields and of cutting-off infra-red rays applied on the display surface. Thus, with this invention it is possible to install color filters into a color plasma display panel at a low cost, and thus this invention makes it practicable to produce a color plasma display panel whose display enjoys high contrast and brightness on account of color filters thus installed.

What is claimed is:

1. A color plasma display panel comprising: discharge electrodes made of transparent electrodes; a first substrate on the display side with a plurality of color filters; a second substrate placed opposite to said first substrate to form a plurality of display cells therebetween; a plurality of phosphors provided at said display cells; an electromagnetic field shielding layer formed on said first substrate so as to be placed on boundaries between said adjacent color filters, said electromagnetic field shielding layer being made of an electroconductive material and having a plurality of windows to dispose said color filters; and an insulating layer formed commonly on said electromagnetic field shielding layer and said color filters.

2. A color plasma display panel according to claim 1, further comprising an additional transparent electrode provided between said first substrate, and said electromagnetic field shielding layer and color filters.

3. A color plasma display panel according to claim 1, wherein said windows of said electromagnetic field shielding layer have a grid pattern relative to the openings of said display cells so that the two practically correspond in position.

4. A color plasma display panel according to claim 1, wherein said electromagnetic field shielding layer is so prepared as to assume a tinge of black, or assume a tinge of practically black as a summation with the tinge of said color filter layers.

5. A color plasma display panel according to claim 1, wherein said color filters are formed after forming said electromagnetic field shielding layer.

* * * * *